US007111843B2

(12) United States Patent
Helmstädter

(10) Patent No.: US 7,111,843 B2
(45) Date of Patent: Sep. 26, 2006

(54) SHEET-PROCESSING MACHINE HAVING A SUCTION AIR PRODUCING DEVICE

(75) Inventor: Karl-Heinz Helmstädter, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 162 days.

(21) Appl. No.: 10/633,995

(22) Filed: Aug. 4, 2003

(65) Prior Publication Data

US 2004/0026850 A1 Feb. 12, 2004

(30) Foreign Application Priority Data

Aug. 2, 2002 (DE) ..... 102 35 411

(51) Int. Cl.
*B65H 5/02* (2006.01)

(52) U.S. Cl. ..... 271/276; 271/196; 271/197; 101/229; 101/419

(58) Field of Classification Search ..... 271/276, 271/196, 197; 101/229, 230, 231, 232, 419, 101/420
See application file for complete search history.

(56) References Cited

U.S. PATENT DOCUMENTS 3,618,935 A * 11/1971 Howatt ..... 271/276
4,090,702 A * 5/1978 Wirz ..... 271/108
4,548,396 A 10/1985 Nelen
5,431,386 A * 7/1995 Blaser ..... 271/204
5,482,267 A * 1/1996 Haupenthal ..... 271/276
6,139,004 A * 10/2000 Couillard et al. ..... 271/70
6,648,321 B1 * 11/2003 Jensen ..... 271/98

FOREIGN PATENT DOCUMENTS

| | | |
|---|---|---|
| CA | 2139783 | 6/1993 |
| DE | 42 23 839 C1 | 12/1993 |
| DE | 43 32 491 C2 | 3/1995 |
| DE | 43 35 185 C2 | 4/1995 |
| DE | 195 45 799 C1 | 1/1997 |
| DE | 101 43 098 A1 | 6/2002 |
| EP | 0 095 218 A1 | 11/1983 |

* cited by examiner

*Primary Examiner*—Kathy Matecki
*Assistant Examiner*—Thomas Morrison
(74) *Attorney, Agent, or Firm*—Laurence A. Greenberg; Werner H. Stemer; Ralph E. Locher

(57) ABSTRACT

A sheet-processing machine includes a revolving sheet holding device for aiding in transporting sheets to be processed. A device for producing suction air or air blast has a movable air delivery element accommodated on the revolving sheet holding device. An actuating element cooperatively engages with the air delivery element for driving the air delivery element. The actuating element is either fixed to a frame of the machine or is movable relative to the sheet holding device.

10 Claims, 7 Drawing Sheets

SHEET-PROCESSING MACHINE HAVING A SUCTION AIR PRODUCING DEVICE

BACKGROUND OF THE INVENTION

Field of the Invention

The invention relates to a device for producing suction air or vacuum intake in a sheet-processing machine, more particularly a sheet-fed rotary printing press, wherein a sheet to be processed is transported with the aid of a revolving sheet holding device. The suction-air producing device includes a movable air-conveyor element.

In sheet-fed rotary printing presses, the paper sheets to be printed are taken from a sheet pile and, with the aid of grippers disposed on cylinders and drums, are transported through the individual printing units of the printing press in order to print therewith in one, two or more colors. In that regard, the grippers are fixed conventionally to gripper shafts, which are disposed in a channel in the periphery of the respective cylinder of the printing press and which transport the sheets through the machine.

In that regard, in particular at high production speeds of the press, the problem arises that the trailing edges of the sheets held at their leading edges by the grippers are not guided on an optimum path of movement, because of the centrifugal forces which occur. As a result thereof, smearing and losses in terms of the print quality can occur.

In that connection, German Published, Non-Prosecuted Patent Application DE 101 43 098 A1, corresponding to U.S. application Ser. No. 09/998,719, filed Nov. 30, 2001 and to U.S. Patent Application Publication No. 2002/078843 A1, which are owned by the corporate assignee of the instant application, discloses holding and guiding the trailing edge of the sheet as it is transported through the printing press by a trailing-edge holding device which has a suction bar guided on two revolving endless belts, to which a plurality of suction elements are fixed that are disposed at a distance from one another and which attract the trailing edge of a sheet by suction and then guide the edge on an optimum path of movement. The text of that German application makes no reference to producing the suction air or vacuum by a pump revolving with the suction bar.

In conventional sheet-fed rotary printing presses, sheets are reversed with the aid of reversing or turning devices having one or more suction grippers which are swivelable out of the periphery of a cylinder of the reversing device. The suction grippers serve for gripping the sheets to be reversed at the trailing edge thereof, and transferring the latter to a further gripper device after the suction grippers have swiveled back into the periphery of the cylinder. After the sheet trailing edge has been accepted by the further gripper device, the latter is swiveled counter to the direction of rotation of the rotating cylinder of the reversing device and transfers the sheet trailing edge as a new sheet leading edge into the gripper device of a cylinder disposed farther downstream, for example the grippers of an impression cylinder of the printing unit disposed downstream from the reversing device, for printing the rear side of the respective sheet.

In order to acquire by suction the trailing edge of the sheets to be reversed, vacuum is applied to the suction grippers. The vacuum is produced by an external vacuum source, for example a blower or a piston pump or any other pump, and supplied to the suction head of the suction gripper through a rotary valve disposed on the outer side of the rotating cylinder and a generally flexible feeder line. A rotary valve of that type is disclosed, for example, in German Patent DE 43 32 491 C2.

German Patent DE 43 35 185 C2 furthermore discloses a reversing device in a sheet-fed rotary printing press wherein the suction air or vacuum for the suction grippers serving for gripping the sheet trailing edge is supplied from an external suction air or vacuum source through an air supply line led along the axis of rotation of the reversing drum, and control valves disposed in the interior of the reversing drum and co-rotating therewith. Also, no reference is made in the text to arranging the suction air or vacuum source on the reversing drum itself.

SUMMARY OF THE INVENTION

It is accordingly an object of the invention to provide a sheet-processing machine having an alternative suction air producing device, which overcomes the hereinafore-mentioned disadvantages of the heretofore-known devices of this general type and with which provision of a suction air or vacuum supply to rotating parts of the machine is enabled in a simple and reliable manner.

With the foregoing and other objects in view, there is provided, in accordance with the invention, in a sheet-processing machine, a combination, comprising a revolving sheet holding device for aiding in transporting sheets to be processed, a device for producing suction air or air blast having a movable air delivery element accommodated on the revolving sheet holding device, and an actuating element cooperatively engaging with the air delivery element for driving the air delivery element. The actuating element is fixed to a frame of the machine and/or movable relative to the sheet holding device.

In accordance with another feature of the invention, the revolving sheet holding device includes a suction bar extending transversely to sheet transport direction, and having suction elements disposed thereon. Two endlessly revolving flexible drives hold the suction bar by the ends thereof.

In accordance with a further feature of the invention, the air delivery element is integrated in the suction bar.

In accordance with an added feature of the invention, a multiplicity of the suction elements are mounted on the suction bar at a spaced distance from one another. The suction elements serve for attracting the sheets at the trailing edge thereof by suction.

In accordance with an additional feature of the invention, the suction bar is formed with a longitudinally extending connecting line through which suction air is applicable by the air delivery element jointly to the suction elements.

In accordance with yet another feature of the invention, at least one further air delivery element for acting on at least one further suction element is accommodated on the suction bar. The at least one further air delivery element is driven by the actuating element alone.

In accordance with yet a further feature of the invention, the movable air delivery element is formed as an impeller rotatable within a cylindrical pump housing of an oscillating pump. The impeller has a drive connection through a rotational drive shaft to a roller element rolling on a cam disk fixed to the frame and forming the actuating element.

In accordance with yet an added feature of the invention, a plurality of movable impellers are accommodated on the suction bar and are drivable by a common drive shaft.

In accordance with yet an additional feature of the invention, the movable air delivery element is formed as a piston displaceable within a cylindrical pump housing of a piston pump, and is movable reciprocatingly by a piston rod. The piston rod is guidable for producing an axial movement by one end thereof along an axial cam track fixed to the frame and forming the actuating element.

In accordance with still another feature of the invention, the combination includes a roller for supporting the one end of the piston rod on the cam track. The piston is acted upon by a resilient force for urging the piston in a direction towards the axial cam track.

In accordance with still a further feature of the invention, a plurality of movable pistons are accommodated on the suction bar and are movable reciprocatingly by a common piston rod.

In accordance with still an added feature of the invention, the movable air delivery element is formed as a suction head having a cylindrical inner bore and is supported by a resilient element for moving on a piston element accommodated in the cylindrical inner bore and connected to the sheet holding device. The suction head is movable counter to the action of the resilient element by a sheet supporting face forming the actuating element and belonging to a rotating sheet transport device, for producing the suction air.

In accordance with still an additional feature of the invention, the cylindrical inner bore has a flow connection through a venting valve to the surroundings. The flow connection is provided for enabling air contained in the cylindrical inner bore to escape from the inner bore when the suction head is moved in a direction towards the piston element.

In accordance with another feature of the invention, the movable air delivery element is formed as a bellows supported at one end thereof on the sheet holding device, and the other end thereof has a suction face for making contact with a respective sheet and, for producing the suction air, is urged, counter to inherent stiffness of the bellows, in a direction towards the sheet holding device by a sheet supporting face forming the actuating element and belonging to a rotating sheet transport device.

In accordance with a concomitant feature of the invention, the bellows has an interior space connected flowwise to the surroundings through a venting valve for enabling air contained in the interior space to escape when the bellows is compressed by the sheet supporting face.

Thus, according to the invention, a device for producing suction air or vacuum in a sheet-processing machine, wherein the sheets to be processed are transported with the aid of a revolving sheet holding device, includes a movable air delivery element, which is fixed to the revolving sheet holding device and revolves with the latter. The drive for the air delivery element is in this case provided, according to the invention, by the cooperation of the air delivery element with an actuating element which is disposed outside the sheet holding device. According to a first embodiment of the invention, the actuating element is fixed to the frame or another stationary part of the press. Alternatively, according to a further embodiment of the invention, the actuating element is moved relative to the sheet holding device, for example by being disposed on a rotating printing-press drum or cylinder and revolving therewith.

This results in the advantage that, as opposed to conventional rotary leadthroughs, virtually wear-free operation of the suction-air producing device is made possible if it is used instead of an external vacuum source, for example on a sheet-carrying cylinder or a drum of the printing press. In addition, the space inside and outside the drum, which is saved by the omission of the rotary leadthrough and the external vacuum source and feed lines, can expediently be used by other components of the printing press.

A further advantage of the suction-air producing device according to the invention is that the suction-air or vacuum feed lines to the suction elements of the sheet holding device can be kept comparatively short. Due to this factor, the suction air or vacuum to be produced is established within an extremely brief time, which has a positive effect on the print quality and, in addition, permits the printing speed to be increased.

The suction-air producing device according to the invention is preferably used in a revolving sheet holding device, as described in German Published, Non-Prosecuted Patent Application DE 101 43 098 A1, corresponding to U.S. application Ser. No. 09/998,719, filed Nov. 30, 2001 and to U.S. Patent Application Publication No. 2002/078843 A1, which are owned by the corporate assignee of the instant application. In that device, the sheets are attracted by suction and guided at the trailing edge thereof by suction elements belonging to a suction bar extending transversely to the sheet transport direction and fixed to revolving endless belts, chains or toothed belts, which lead the suction bar along a predefined optimized path of movement around associated cylinders and drums of the printing press. In this case, the advantage manifests itself in that a suction air or vacuum supply is possible in the case of any desired path of movement of the suction elements, which cannot be implemented, for example, with rotary leadthroughs.

Although the invention is illustrated and described herein as embodied in a sheet-processing machine having a suction air producing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
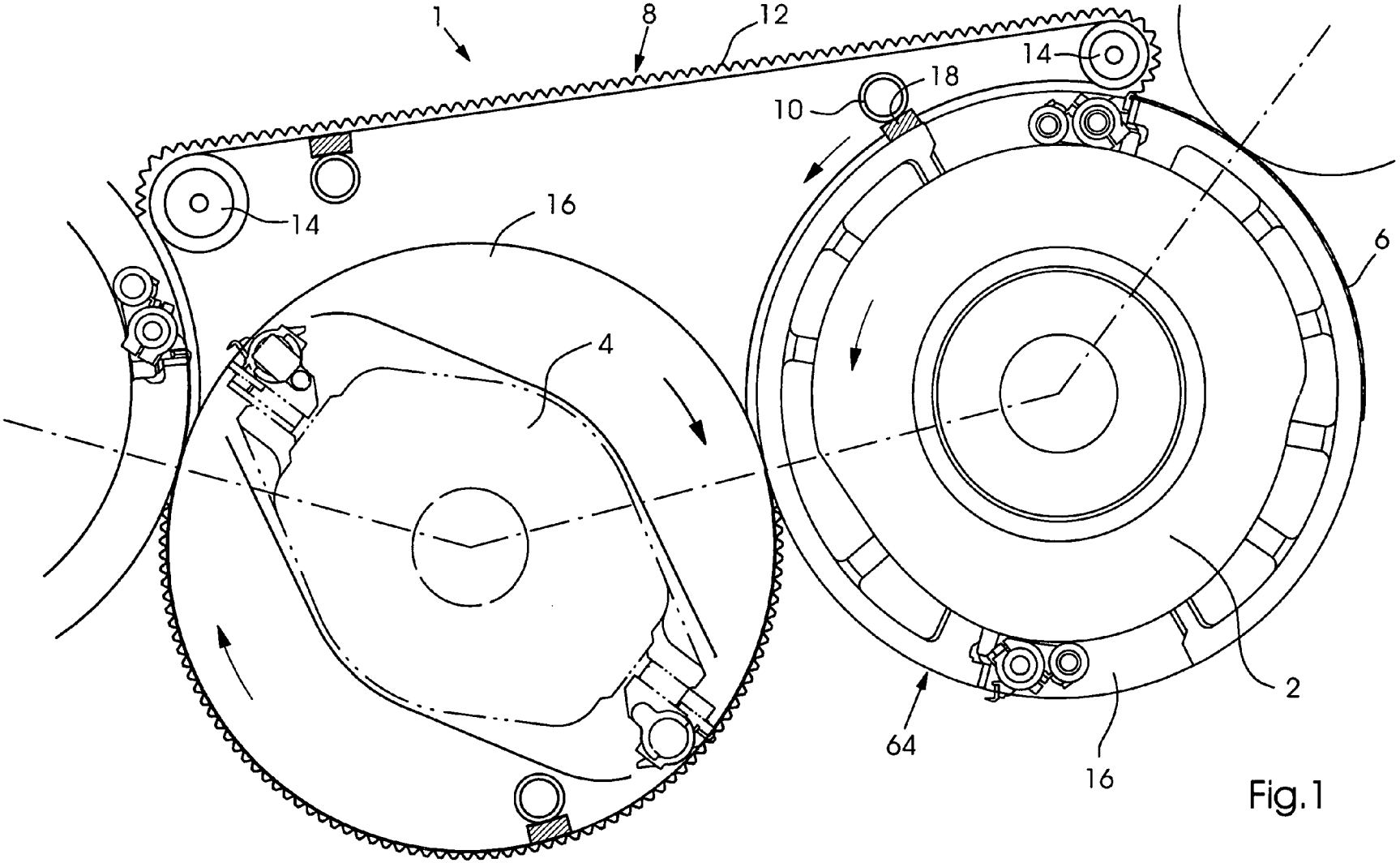
FIG. 1 is a fragmentary, diagrammatic, side-elevational view of a sheet-fed rotary printing press having a sheet holding device, wherein in the vicinity of the periphery of an impression cylinder and a transfer drum disposed downstream of the latter, the sheets are guided at the trailing edge thereof by suction bars, which are mounted on endlessly revolving toothed belts.

Referring now to the figures of the drawings in detail and first, particularly, to FIG. 1, thereof, there is seen a sheet-processing machine 1, including an impression cylinder 2 and a transfer drum 4 disposed downstream of the latter, which are provided with otherwise non-identified gripper devices for gripping a leading edge of sheets 6 transported through the sheet-processing machine 1. The impression cylinder 2 may be considered a rotating sheet transport device.

According to FIG. 1, in the vicinity of the periphery of the impression cylinder 2 and of the transfer drum 4, the sheets 6 are held and guided at the trailing edges thereof by a revolving sheet-holding device 8. The device 8 is made up of at least one suction bar 10 which extends in a direction transverse to the impression cylinder 2 and which, according to FIG. 1, is fixed at respective ends thereof to a first and a second revolvable flexible drive formed as a toothed belt or a chain 12.

In this case, the first and second toothed belts 12 are guided over deflection rollers 14 and toothed belt pulleys 16, which are disposed at mutually opposite ends of the impression cylinder 2 and the transfer drum 4. When chains are used, guidance is provided by appropriate sprockets and pinions.

Figure 2:
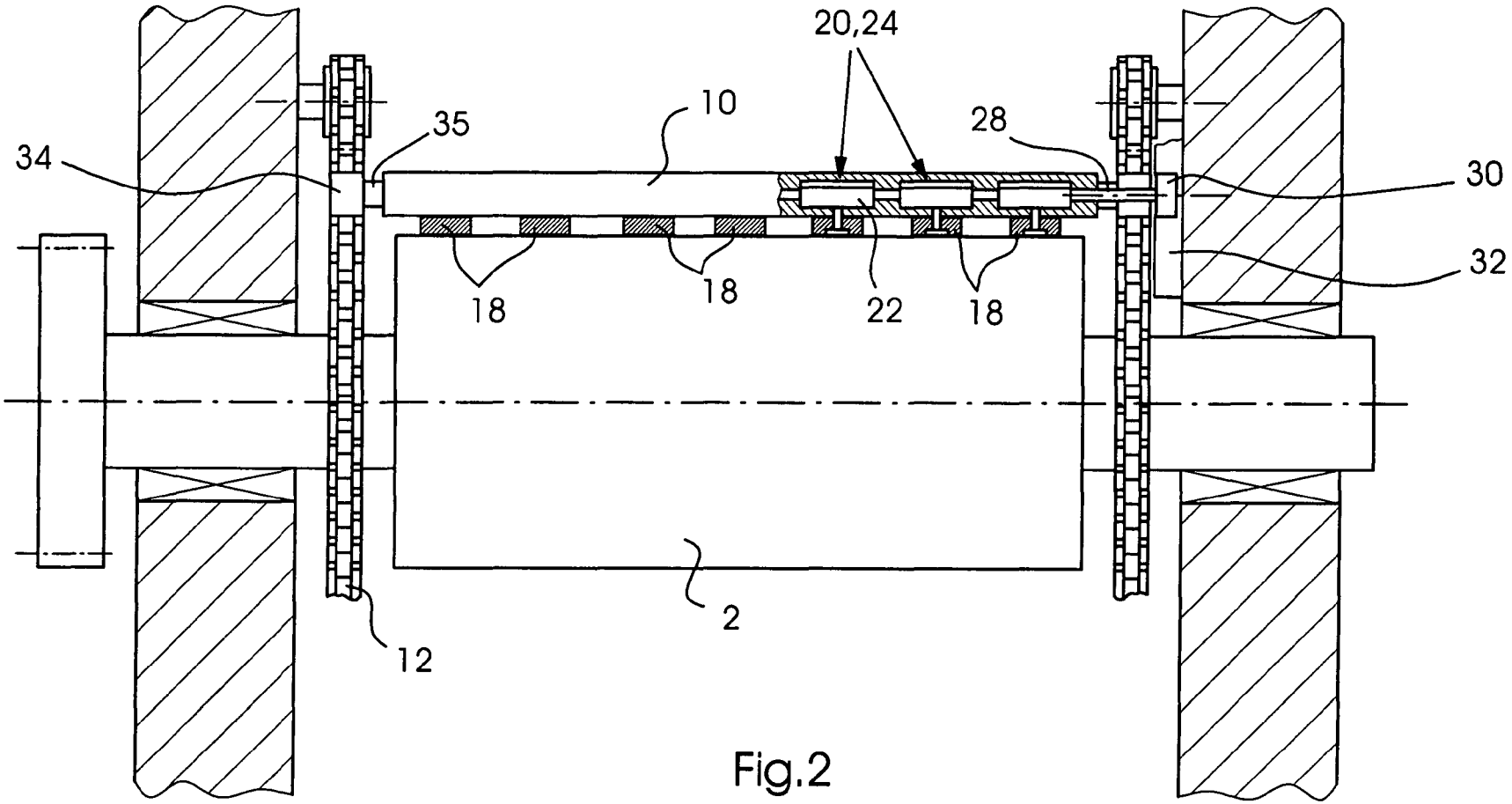
FIG. 2 is a fragmentary, top-plan view, partly in section, of FIG. 1, showing a further embodiment of the invention, wherein suction air or vacuum is produced by one or more oscillating pumps disposed in the suction bars.
Figure 3:
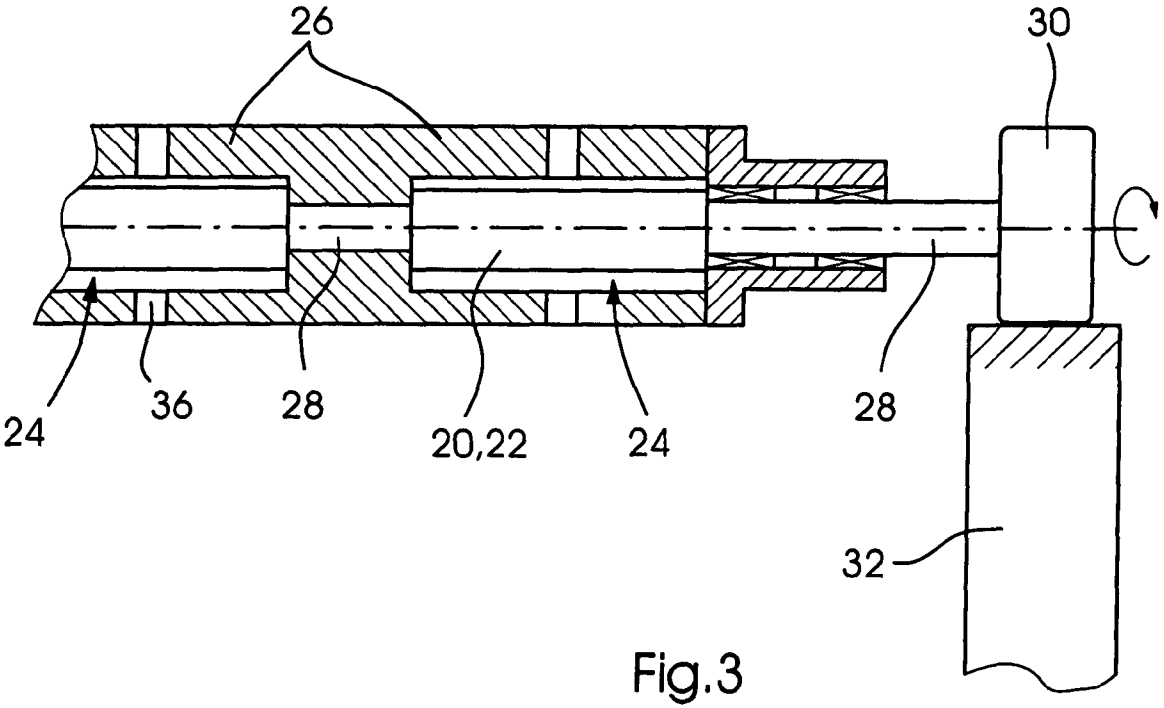
FIG. 3 is an enlarged, fragmentary, top-plan view of FIG. 2, showing the suction bar in section.

As is illustrated in FIG. 2, each suction bar 10 includes a multiplicity of suction elements 18, which are disposed at a spaced distance from one another. The suction elements 18 are connected through a connecting line, that is not otherwise specifically illustrated in FIG. 2, to one or more air conveying elements 20. In the embodiment of the invention illustrated in FIG. 2, the conveying elements 20 are configured as an impeller 22 of an oscillating pump 24. Oscillating pumps of this type are known in the prior art for conveying or delivering air and other gaseous and liquid media and are illustrated in detail in FIGS. 3 and 4. As is shown in FIG. 3, the oscillating pump 24 has a pump housing 26 integrated in the suction bar 10. The impeller 22 is accommodated eccentrically in a conventional manner for oscillating pumps, and is driven by a drive shaft 28.

According to FIG. 3, in the preferred embodiment of the invention of the instant application, a plurality of oscillating pumps 24 are preferably disposed adjacent one another within the suction bar 10 and are driven by one and the same drive shaft 28. The drive shaft 28 has a free end to which there is fixed a roller element 30 that rolls on a cam disk 32 that is fixed to the frame and thus constitutes an actuating element for driving the oscillating or vane-type cell pumps 24 through the drive shaft 28. The parallel diagonal lines associated with the cam disk 32 indicate the machine frame to which the cam disk 32 is fixed.

Figure 4:
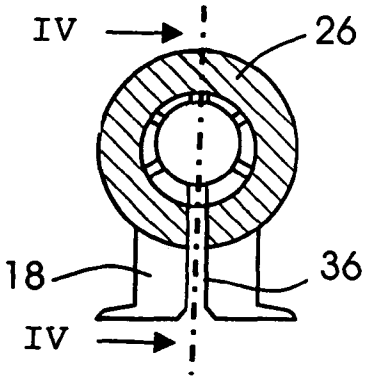
FIG. 4 is an enlarged, cross-sectional view of FIG. 3, taken along a line IV—IV, in the direction of the arrows, and showing the respective oscillating pump.

According to FIG. 4, the drive shaft 28 can extend in the same manner over the entire width or breadth of the impression cylinder 2 and can be provided with a further roller element 34 which, on the opposite side, likewise rolls on a further frame-fixed but not otherwise specifically illustrated cam disk. That results in an advantageous symmetrical introduction of forces into the suction bar 10 from both sides.

The interior of the pump housing 26 is thereby connected to the suction elements 18 through a connecting line 36 in the manner illustrated in FIGS. 2 and 3.

Figure 5:
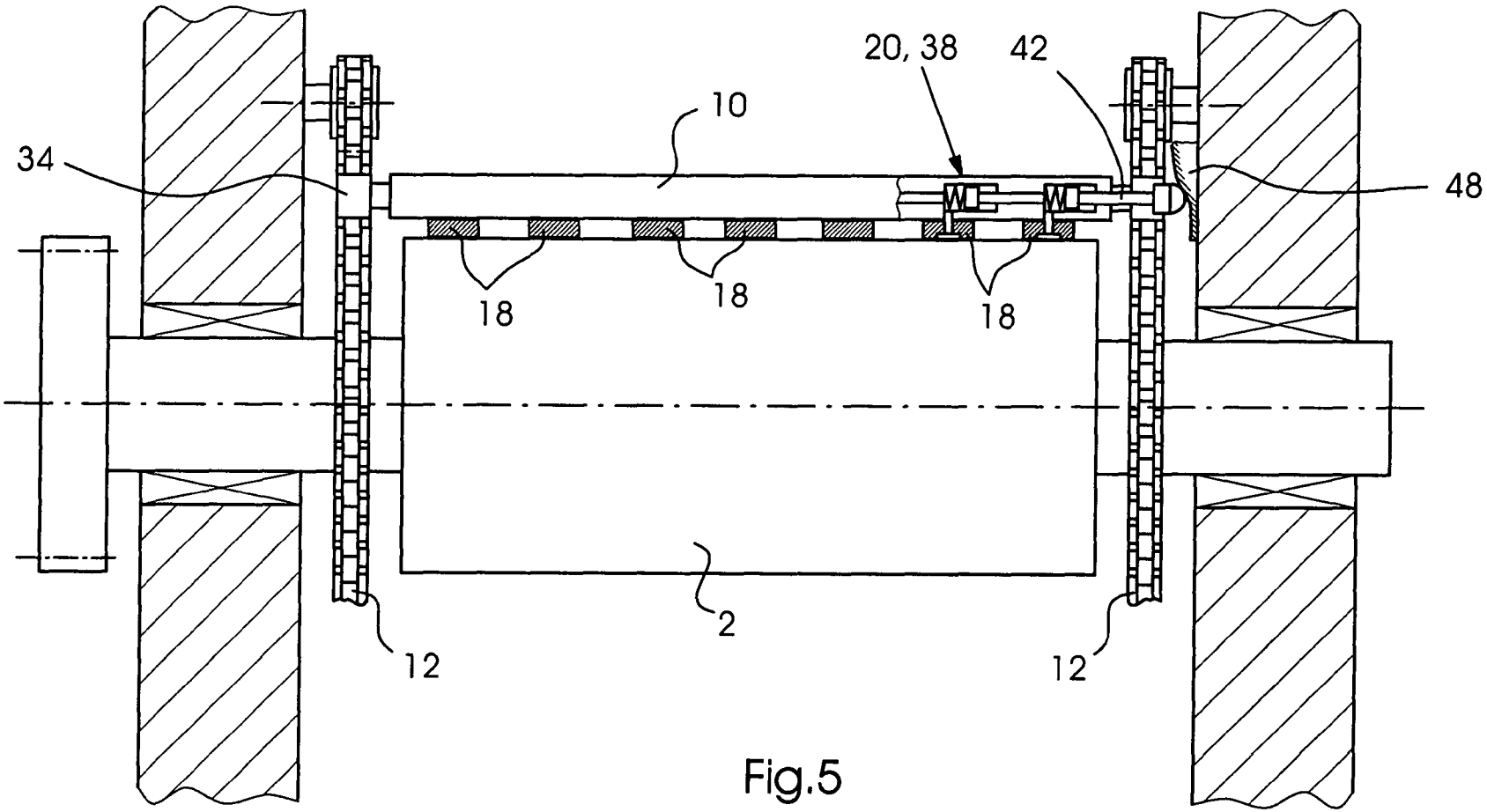
FIG. 5 is a view similar to that of FIG. 2, showing a further embodiment of the invention, wherein suction air or vacuum is produced by one or more axially displaceable piston pumps accommodated in the suction bars.
Figure 6:
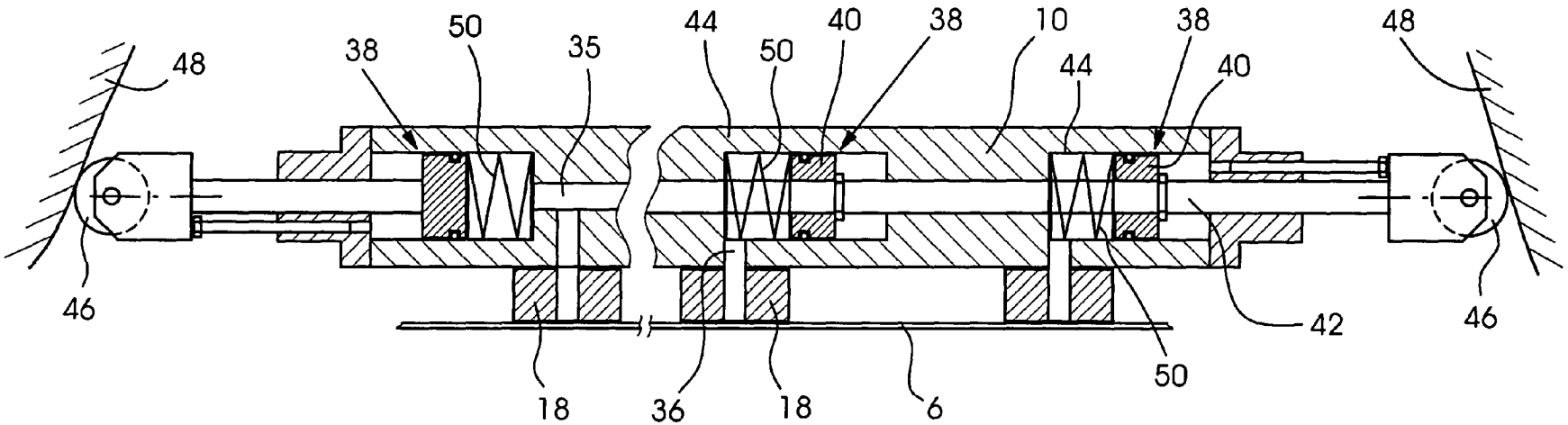
FIG. 6 is an enlarged, sectional view of the suction bar of FIG. 5, wherein a drive for the pistons is provided on both sides by piston rods cooperating with frame-fixed axial cam tracks disposed outside the path of movement of the suction bar.

According to a further embodiment of the invention which is illustrated in FIGS. 5 and 6, the vacuum is produced by one or more piston pumps 38 disposed in the suction bar 10. The movable air conveying element 20 is formed as a piston 40, which is oscillatingly movable in the axial direction of the suction bar 10 by a piston rod 42 extending in the longitudinal direction of the suction bar 10.

In this regard, the piston rod 42 preferably simultaneously connects two or more pistons 40, each of which are guided in a cylindrical pump housing 44, which is preferably formed integrally with the suction bar 10.

In this regard, a free end of the piston rod 42 is preferably supported through a roller 46 on an axial cam track 48. The axial cam track 48 is fixed to the frame and, in this regard, forms the actuating element for actuating the piston pumps 38 integrated in the suction bar 10. The parallel diagonal lines associated with the axial cam track 48 indicate the machine frame to which the axial cam track 48 is fixed.

In this case, the pistons 40 are subjected to or acted upon by a resilient force provided by spiral or helical compression springs or similar spring-resilient elements 50, which urge the pistons 40 and, therefore, also the piston rods 42 and the roller 46 fixed to the latter against the axial cam track 48 fixed to the frame.

In the same manner as in the embodiment of the invention shown in FIGS. 2 and 3, the interior of the pump housing 44 is connected through a connecting line 36 to a suction element 18 operatively associated therewith, it being possible in the same way to supply a plurality or all of the suction elements 18 of a suction bar 10 through a common connecting line 35 by a single piston pump 38.

Preferably, however, a great number of piston pumps 38 are provided, which results in a particularly short connecting line 36 to the suction elements 18 and, therefore, advantageous, spontaneous propagation of the negative pressure as the sheet 6 is attracted by suction.

By providing an appropriate configuration of the axial cam track 48, it is likewise possible, in this embodiment of the invention, to nullify or terminate the suction action by inserting the piston rod 42 without further accessories at an exactly prescribed time, in order to detach or loosen the sheet 6 from the suction elements 18 again. Paper dust which may possibly likewise be attracted by suction is blown out of the connecting line 36 and the suction elements 18, thereby advantageously reducing the risk of blockage of the connecting lines 36.

According to FIG. 6, it is likewise possible to mount piston pumps on both sides of the suction bar 10, the configuration of the axial cam tracks 48 in this case preferably being provided so that the forces on the suction bar 10 when the piston pumps 38 are operated cancel one another out.

Figure 7:
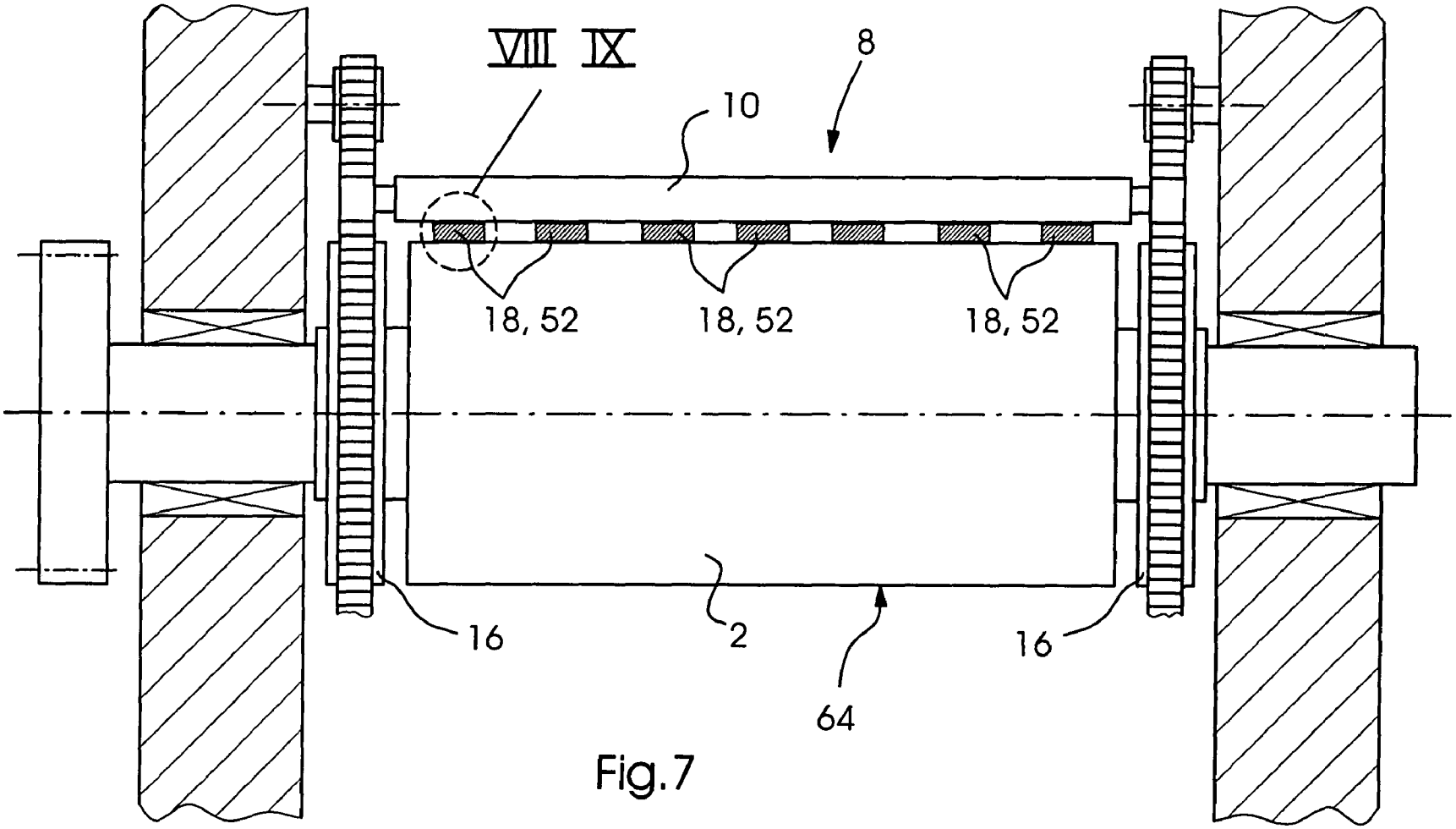
FIG. 7 is a view similar to that of FIG. 2 showing yet a further embodiment of the invention, wherein suction air or vacuum is introduced by suction elements having a suction head or bellows that is movable with respect to the suction bar and comes into contact with the sheet supporting face of a sheet-carrying cylinder or a transfer drum in order to produce the suction action.
Figure 8:
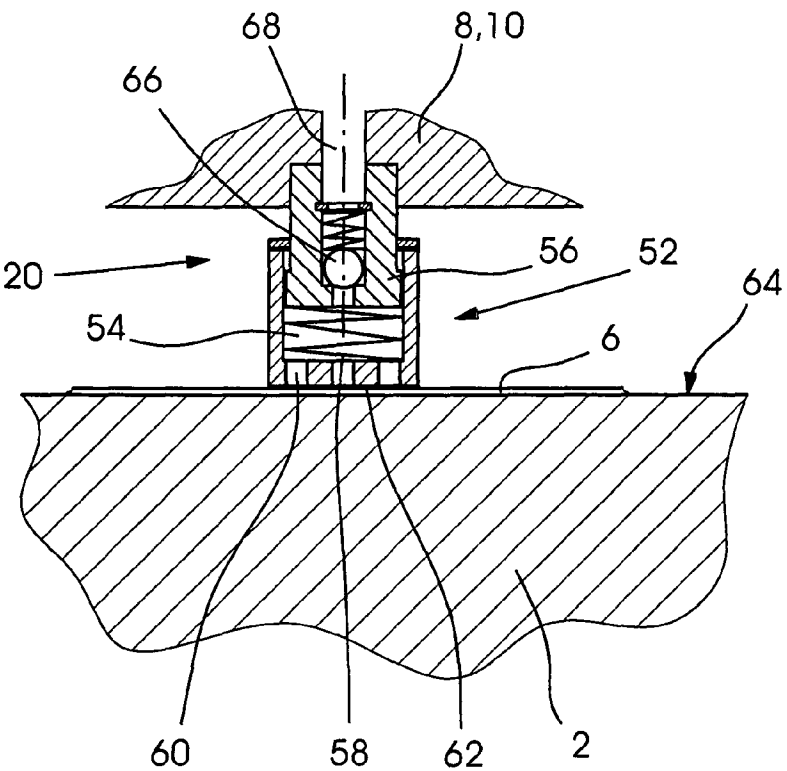
FIG. 8 is an enlarged, fragmentary, sectional view of FIG. 7 showing, within a broken-line circle at VIII, details of a movable suction head.

According to the further embodiment of the invention illustrated in FIGS. 7 and 8, the movable air-conveyor or air delivery element 20 is formed as a suction head 52 having a cylindrical inner bore 54, wherein a likewise cylindrically formed piston element 56 is accommodated, preferably firmly connected to the suction bar 10.

In this regard, the suction head 52 is braced against the piston element 56 by a spring 58, which in turn acts upon a suction face 62 of the suction head 52, which is formed with suction openings 60.

In order to attract a sheet 6 by suction, the suction head 52 is urged, by appropriate positioning of the suction bar 10, against the circumferential surface 64 of the impression cylinder 2 which is supporting the sheet 6, and the suction head 52 is moved in the direction towards the suction bar 10 counter to the force of the spring 58, the air contained in the cylindrical inner bore 54 preferably escaping into the surroundings through a venting or relief valve 66 and a venting channel 68. The venting valve 66 is preferably formed as a spring-loaded ball valve. In connection therewith, the suction bar 10 is raised slightly off the circumferential surface 64 of the impression cylinder 2, as a result of which the spring 58 likewise moves the suction head 52 away from the piston element 56, producing a negative pressure which attracts or pulls the sheet 6 against the suction face 62 by suction.

Figure 9:
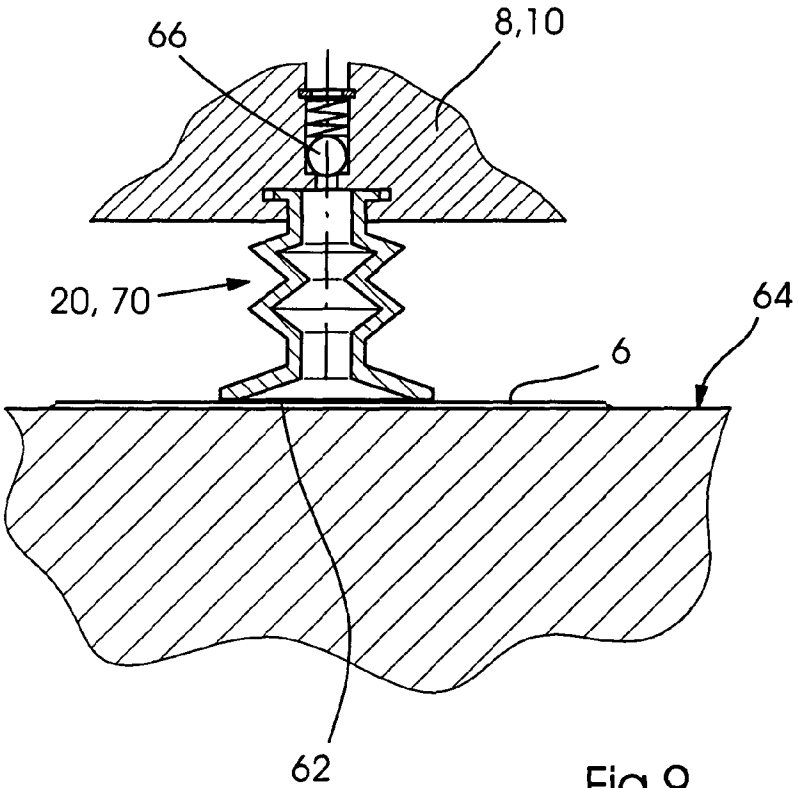
FIG. 9 is an enlarged, sectional view of FIG. 7 showing, within a broken-line circle at IX, details of bellows.

According to a further refinement in the device according to the invention, as illustrated in FIG. 9, the movable air conveyor or delivery element 20 is formed as a bellows 70, which is supported by one end thereof on the suction bar 10 or generally on the sheet holding device 8, and the other end of the bellows 70, likewise has a suction face 62 which makes contact with the sheet 6 and lifts it off the circumferential surface 64 of the impression cylinder 2 by suction action. In this regard, the suction action is achieved by the fact that the bellows 70 comes into contact with the circumferential surface 64 of the impression cylinder 2 transporting the sheet 6, by appropriate guidance of the suction bar 10 over the deflection rollers 14, and in the process is squeezed together, as a result of which the air contained in the bellows 70 escapes therefrom. When the spaced distance between the suction bar 10 and the circumferential surface of the impression cylinder 2 is subsequently enlarged again, the bellows 70 then extends again because of the inherent elasticity thereof, enlarging the volume of the internal space thereof, as a result of which, because of the suction face 62 covered by the sheet 6, a vacuum is produced in the interior of the bellows 70, which attracts the sheet against the suction face 62 by suction and holds it on the latter.

In order to promote the escape of the air in a specific manner from the bellows 70 as the latter is compressed, the interior of the bellows 70 is preferably connected to the surroundings through a venting valve 66, which is preferably likewise formed as a spring-loaded ball valve.

In the embodiment of FIGS. 8 and 9, it may be advantageous, in this regard, to open the venting valve 66 again, counter to the force of the spring contained therein, with the aid of otherwise non-illustrated lifting elements, for example, mechanically or magnetically actuatable, in order to release the sheet 6 specifically from the suction face 62 at a prescribed position. In the same manner, provision can likewise be made for using the device according to the invention for the production of blast air, which is required in the printing press, by providing an appropriate configuration of the pumps.

I claim:

1. A sheet-processing machine, comprising:

a revolving sheet holding device for aiding in transporting sheets to be processed, said revolving sheet holding device including a suction bar extending transversely to a sheet transport direction and having suction elements disposed thereon and two revolving endless flexible drives holding ends of said suction bar;

a device for producing suction air or air blast, including:

a movable air delivery element accommodated on said revolving sheet holding device, said air delivery element being integrated in said suction bar; and an actuating element cooperatively engaging with said air delivery element for driving said air delivery element, said actuating element being one of fixed to a machine frame and movable relative to said sheet holding device.

2. The sheet-processing machine according to claim 1, wherein a multiplicity of said suction elements are mounted on said suction bar at a spaced distance from one another and serve for attracting the sheets at a trailing edge thereof by suction.

3. The sheet-processing machine according to claim 2, wherein said suction bar is formed with a longitudinally extending connecting line through which suction air is applicable by said air delivery element jointly to said multiplicity of suction elements.

4. A sheet-processing machine, comprising:

a revolving sheet holding device for aiding in transporting sheets to be processed, said revolving sheet holding device including a suction bar extending transversely to a sheet transport direction and having suction elements disposed thereon and two revolving endless flexible drives holding ends of said suction bar;

a device for producing suction air or air blast, including:

a movable air delivery element accommodated on said revolving sheet holding device;

an actuating element cooperatively engaging with said air delivery element for driving said air delivery element, said actuating element being one of fixed to a machine frame and movable relative to said sheet holding device; and at least one further air delivery element accommodated on said suction bar for acting on at least one further suction element, said at least one further air delivery element being driven in common by said actuating element.

5. A sheet-processing machine, comprising:

a revolving sheet holding device for aiding in transporting sheets to be processed;

a device for producing suction air or air blast, including:

a movable air delivery element accommodated on said revolving sheet holding device;

an actuating element cooperatively engaging with said air delivery element for driving said air delivery element, said actuating element being one of fixed to a machine frame and movable relative to said sheet holding device; and said movable air delivery element including an impeller rotatable within a cylindrical pump housing of an oscillating pump, said impeller having a drive connection through a rotational drive shaft to a roller element rolling on a cam disk fixed to the machine frame and forming said actuating element.

6. The sheet-processing machine according to claim 4, wherein a plurality of movable impellers are accommodated on said suction bar and are driven by a common drive shaft.

7. In a sheet-processing machine having a revolving sheet holding device for aiding in transporting sheets to be processed, a device for producing suction air or air blast, comprising:

a movable air delivery element accommodated on the revolving sheet holding device;

an actuating element cooperatively engaging with said air delivery element for driving said air delivery element, said actuating element being one of fixed to a machine frame and movable relative to the sheet holding device; and said movable air delivery element including an impeller rotatable within a cylindrical pump housing of an oscillating pump, said impeller having a drive connection through a rotational drive shaft to a roller element rolling on a cam disk fixed to the machine frame and forming said actuating element.

8. The sheet-processing machine according to claim 1, wherein said movable air delivery element includes a piston to be displaced within a cylindrical pump housing of a piston pump, said piston being reciprocated by a piston rod, said piston rod having one end to be guided along an axial cam track fixed to the machine frame and forming said actuating element, for producing an axial movement of said piston rod.

9. The sheet-processing machine according to claim 8, which further comprises a roller for supporting said one end of said piston rod on said cam track, said piston being acted upon by a resilient force for urging said piston in a direction towards said axial cam track.

10. The sheet-processing machine according to claim 4, wherein a plurality of movable pistons are accommodated on said suction bar and are to be reciprocated by a common piston rod.

* * * * *